US007850106B2

(12) United States Patent
Matlin

(10) Patent No.: US 7,850,106 B2
(45) Date of Patent: Dec. 14, 2010

(54) SHREDDER WITH SECONDARY WASTE CONTAINER

(75) Inventor: Tai Hoon K. Matlin, Round Lake Beach, IL (US)

(73) Assignee: Fellowes, Inc., Itasca, IL (US)

( * ) Notice: Subject to any disclaimer, the term of this patent is extended or adjusted under 35 U.S.C. 154(b) by 343 days.

(21) Appl. No.: 12/173,179

(22) Filed: Jul. 15, 2008

(65) Prior Publication Data

US 2010/0012759 A1 Jan. 21, 2010

(51) Int. Cl.
*B02B 7/02* (2006.01)
*B02C 23/00* (2006.01)

(52) U.S. Cl. ..... 241/100; 241/236

(58) Field of Classification Search ..... 241/100, 241/236; 312/330.1, 211, 212, 249.9, 291
See application file for complete search history.

(56) References Cited

U.S. PATENT DOCUMENTS 4,873,811 A * 10/1989 Izumitani et al. ..... 53/139.1
6,550,701 B1 4/2003 Chang
6,983,903 B2 1/2006 Chang
7,040,559 B2 5/2006 Matlin
7,195,185 B2 3/2007 Matlin
7,311,276 B2 12/2007 Matlin

* cited by examiner

*Primary Examiner*—Bena Miller
(74) *Attorney, Agent, or Firm*—Pillsbury Winthrop Shaw Pittman LLP

(57) ABSTRACT

A shredder is disclosed. The shredder has an external frame, and includes an internal waste container space that has an upper primary waste container, and a lower secondary waste container, all positioned beneath a shredder mechanism that includes a motor and cutter elements. The shredder mechanism is positioned so that shredded waste falls into the primary waste container. In the event that waste falls outside the primary waste container, due to the primary waste container being full or for other reasons, the waste can be caught in the lower secondary waste container. A sweep mounted to the bottom of the primary waste container in some variations can push or pull shredded waste into the secondary waste container as the primary waste container is removed from the external frame in a generally horizontal direction. The secondary waste container may also include a handle to facilitate removal in some variations. Other variations and improvements to shredders are also disclosed.

12 Claims, 6 Drawing Sheets

SHREDDER WITH SECONDARY WASTE CONTAINER

FIELD OF THE INVENTION

The present invention relates generally to shredders. More particularly, the present invention relates to shredders that have an external frame with an internal, removable waste receptacle.

BACKGROUND OF THE INVENTION

Shredders are devices used for the destruction of substrate articles, such as paper, credit cards, and computer media, for reducing these articles into waste. Users typically utilize shredders to destroy sensitive articles, as the waste is difficult to reconstitute into a recognizable whole.

Some shredders are of a form where the shredded articles, after being processed into waste by the shredder mechanism, fall into a receptacle located inside the shredder frame or housing. In these shredders, the internal waste receptacle can be removed and emptied by the user of the shredder. See, e.g., U.S. Pat. No. 7,195,185, the entirety of which is incorporated herein by reference.

The present application endeavors to provide various improvements over known shredders of this form.

SUMMARY OF THE INVENTION

One aspect of the present invention relates to a shredder with a walled frame defining a waste container space, situated beneath a shredder mechanism. The shredder mechanism includes a motor and cutter elements. The motor rotates the cutter elements in an interleaving relationship, shredding the documents that are fed therein. The shredder mechanism is received by the frame in a position where shredded articles are discharged from the mechanism into the waste container space. Positioned within the waste container space is a removable primary waste container, which has an opening facing upwardly to receive the shredded articles discharged from the shredding mechanism. Positioned below the primary waste container is a secondary waste container, which has an opening configured to receive shredded particles which have fallen between the walls of the frame and the primary waste container.

Other objects, features, and advantages of the present application will become apparent from the following detailed description, the accompanying drawings, and the appended claims.

BRIEF DESCRIPTION OF THE DRAWINGS

Features of the invention are shown in the drawings, in which like reference numerals designate like elements. The drawings form part of this original disclosure in which.

DETAILED DESCRIPTION OF THE ILLUSTRATED EMBODIMENT(S)

Figure 1:
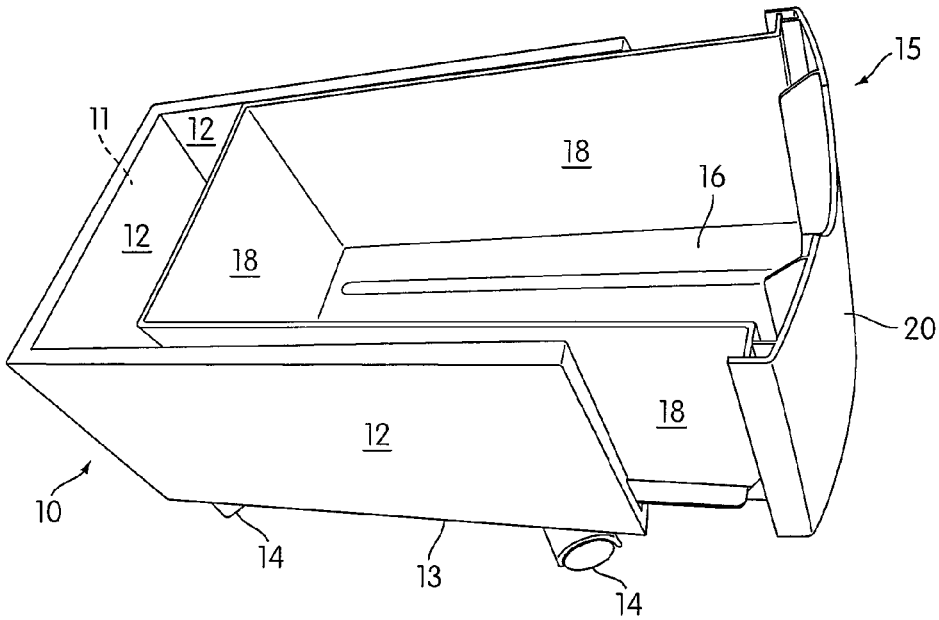
FIG. 1 is a top perspective view of an embodiment of a part of a shredder of the present invention, showing the primary waste container inside the external frame.

FIG. 1 shows a top perspective view of the bottom part of an embodiment of a shredder. The shredder contains an external frame 10, surrounding an interior waste container space 11 and a primary waste container 15. The external frame 10 may have any construction or configuration, and in the illustrated non-limiting embodiment is rectangular in shape, with sidewalls 12, and a bottom floor 13. Wheels, legs, or other features may optionally be attached to the exterior side of external frame floor 13 and still be within the contemplated scope of the invention, as seen in the illustrated embodiment which contains attached casters 14. The primary waste container 15 may have any construction or configuration, and it preferably corresponds to the shape of the external frame 10. In the illustrated non-limiting embodiment, the primary waste container 15 has a bottom portion 16, sidewalls 18, and a front wall 20. The primary waste container 15 also has an upwardly facing opening for receiving shredded documents discharged from the shredder mechanism (not shown).

Figure 2:
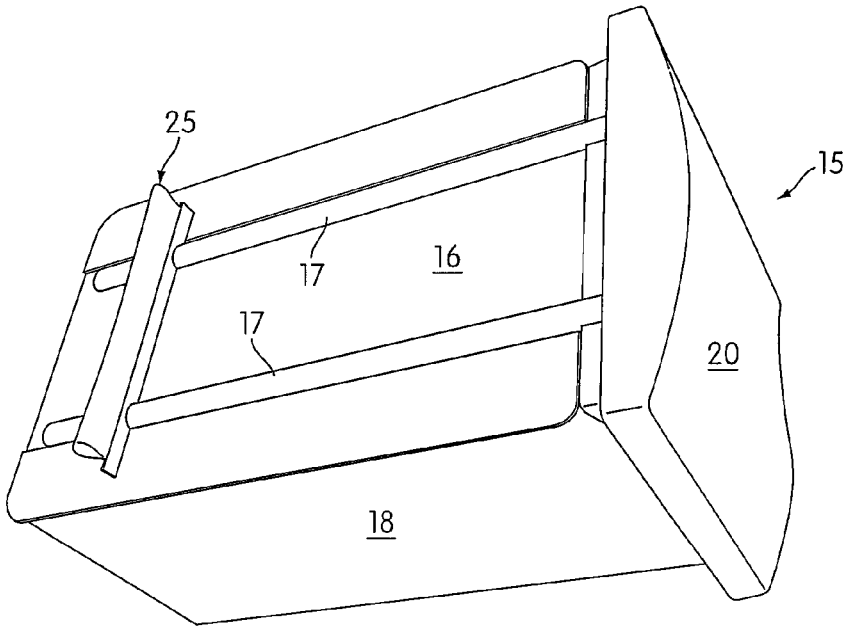
FIG. 2 is a bottom perspective view of the primary waste container in FIG. 1.

As seen in FIG. 2, the primary waste container 15 may optionally have some form of guide system, such as lower guide tracks 17, to facilitate the movement of the primary waste container in a generally horizontal direction with respect to the external frame 10. Other guide systems are possible, such as hanging guide rails and tracks, which would be mounted to or otherwise provided on the exterior of the primary waste container walls 18 and the interior of the external frame side walls 12. Likewise, the guide system may be entirely omitted.

As another option, the primary waste container may pivot when being removed, as shown for example in the above-incorporated '185 patent. In general, the primary waste container 15 may have any construction and may be mounted or received in the frame 10 in any suitable manner In the illustrated embodiment, a sweep 25 is preferably, but optionally, mounted to the exterior side of the bottom 16 of the primary waste container 15. The sweep 25 can also be mounted at the side or edge of primary waste container 15. The sweep 25 can be of any construction or configuration, including but not limited to a rubber wiper, bristles, or mop-like textile material. The sweep 25 may also utilize an electrostatic method to collect shredded paper. The sweep 25 may be flexible and flaccid, flexible and resilient, or rigid. Any suitable structure that extends downwardly from the primary waste container 15 for sweeping or otherwise moving shredded paper on the floor 13 may be used as the sweep 25. Preferably the sweep 25 will be mounted to the underside of the primary waste container bottom 16 at a point furthest from the front wall 20 (i.e., the rear side), so as to cover the maximum distance when the primary waste container 15 is being removed from or inserted into the external frame 10.

Figure 3:
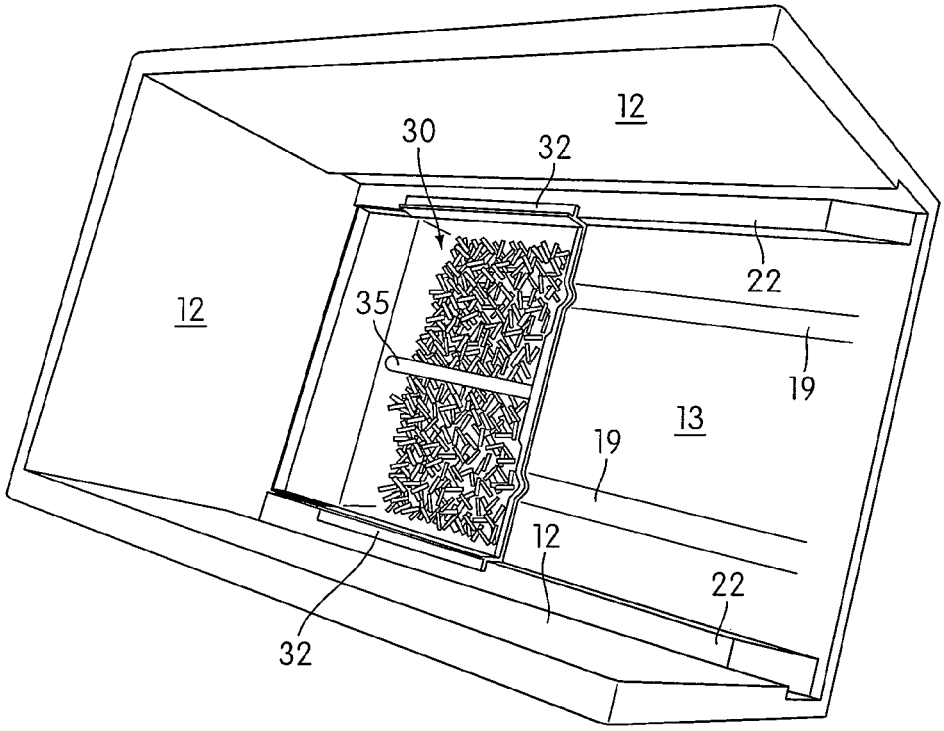
FIG. 3 is a top perspective view of the embodiment of FIG. 1 with the primary waste container featured in FIG. 2 removed.

FIG. 3 shows a view similar to that of FIG. 1 after removal of the primary waste container 15. Grooves 19 are present on the floor 13 to receive and guide the lower guide tracks 17 that are utilized in this embodiment. In addition to using lower guide tracks to guide the movement of the primary waste container in the generally horizontal direction, the interior of the external frame floor 13 may also incorporate ramps 22 on either side that act to lift the primary waste container 15 slightly, allowing clearance for the sweep 25 to operate in contact with the floor 13.

Also seen in FIG. 3 is the secondary waste container 30, which could be located at any point under the primary waste container 15. In terms of being below the primary waste container 15, the secondary waste container 30 may be directly below the primary waste container, or it may be below the primary waste container in general at a lower elevation, but partially or entirely off to the front, side or rear. It is preferred for the secondary waste container 30 to be entirely directly below the primary one, as the overall footprint in terms of area is smaller. It is also preferable (but optional) that the secondary waste container 30 be located at a point on the external frame floor 13 that is closer to the front wall 20 of the primary waste container 15. The opposing placements of the sweep 25 and the secondary waste container 30 will ensure that as the primary waste container 15 is being removed from and/or inserted into the external frame 10 in a generally horizontal direction, any shredded particles that have fallen onto the interior of frame floor 13 will be swept by the sweep 25 into the secondary waste container 30.

Figure 4:
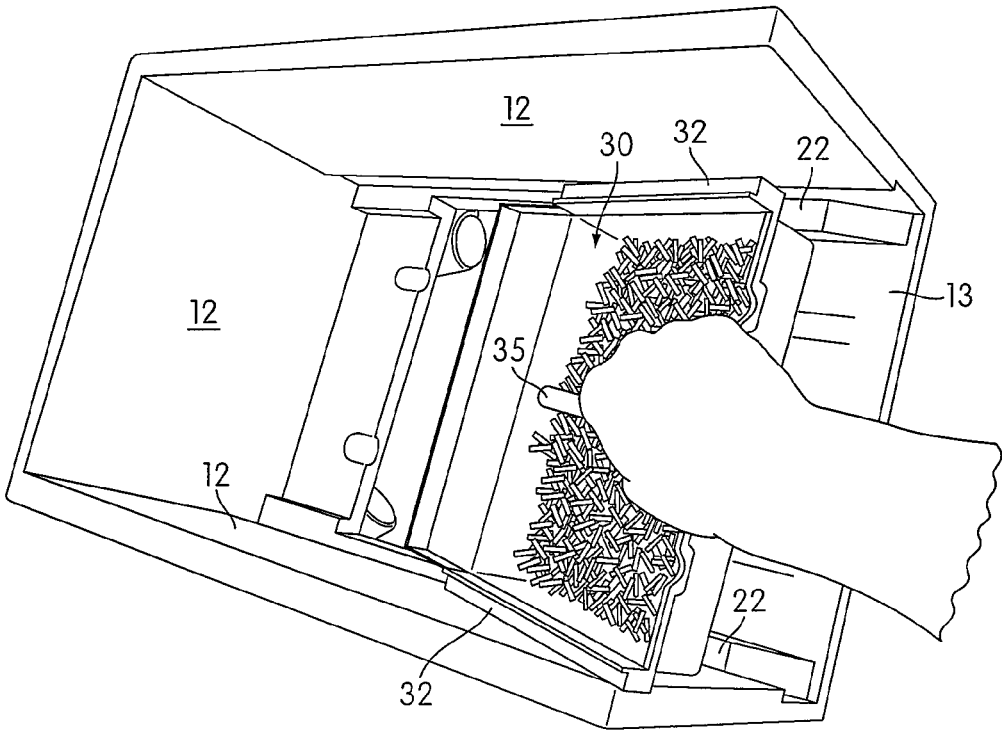
FIG. 4 is a top perspective view of the embodiment of FIG. 1 showing the removable nature of the secondary waste container in this embodiment.

If the secondary waste container 30 is removable, as depicted in the embodiment in FIG. 4, its removal may leave an opening in the external frame floor 13. In this case, the secondary waste container 30 may have flanged edges 32 to engage and be supported by the external frame floor 13. As seen in the side cutaway view of an embodiment in FIG. 5, the external frame floor 13 may have a recessed shoulder along the edge of an opening in the floor for receiving and supporting the flanged edges so that the secondary waste container's flanged edges 32 are flush with the remainder of the frame floor 13. Likewise, instead of being open beneath the shredder, the opening could be the upwardly facing opening of a well with bottom and side walls in which the secondary waste container 30 is received. In an embodiment with a removable secondary waste container, the secondary waste container 30 may also have an optional handle 35 to facilitate such removal for emptying.

In an embodiment where the sweep 25 is omitted, the user can sweep the shredded particles from the floor into the secondary waste container manually, such as by hand, or with a small brush. In a variation of such an embodiment, a large, removable secondary waste container may constitute the entire floor of the shredder, whereby any shredded particles that fall from the primary waste container would fall into the secondary waste container.

Figure 5:
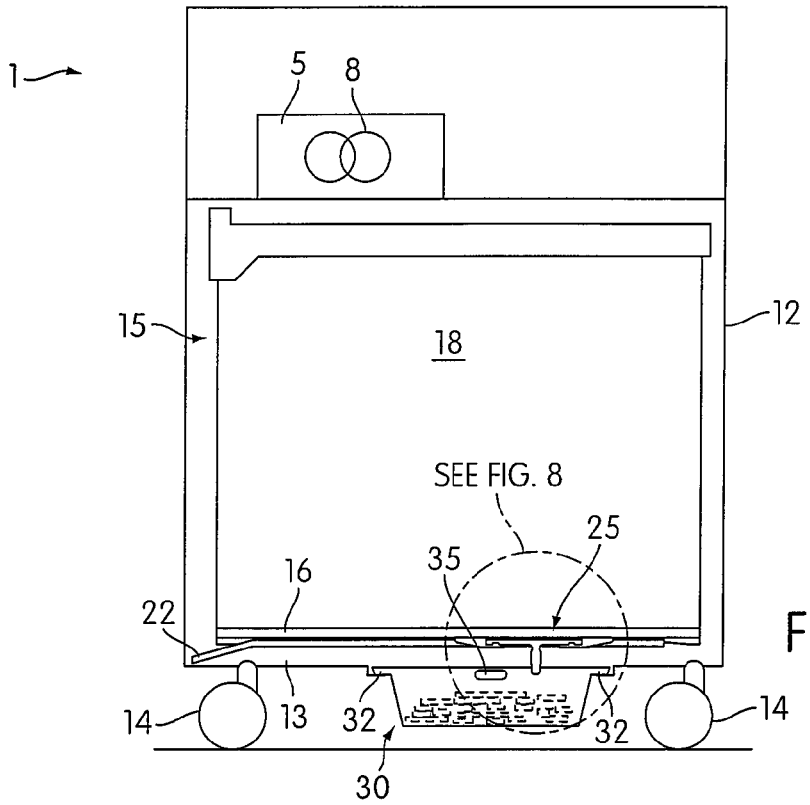
FIG. 5 is a schematic cutaway profile view of the entire shredder of the embodiment of FIG. 1, showing a primary waste container with mounted sweep within an external frame, with a lower secondary waste container below the primary waste container.

The cutaway side profile view of FIG. 5 shows an embodiment of the entire shredder 1. This view of the illustrated embodiment also shows the positioning of the shredder mechanism 5, with cutter elements 8 used in this embodiment of the invention. As documents in the form of paper, computer media, credit cards, or other data bearing substrate articles are fed through the motor driven cutter elements 8 of the shredder mechanism 5, shredded waste will generally fall into the primary waste container 15. The shredder mechanism is only shown schematically, and may have any suitable construction. Reference may be made to the non-limiting examples in the following U.S. Pat. Nos. 7,311,276; 7,040,559; and 6,983,903, the entirety of each of which are hereby incorporated into the present application by reference. Occasionally, possibly due to the overfilling of the primary waste container, pieces of shredded waste may fall between the primary waste container 15 and the external frame 12, landing on the external frame floor 13, or in the lower secondary waste container 30.

Figure 6:
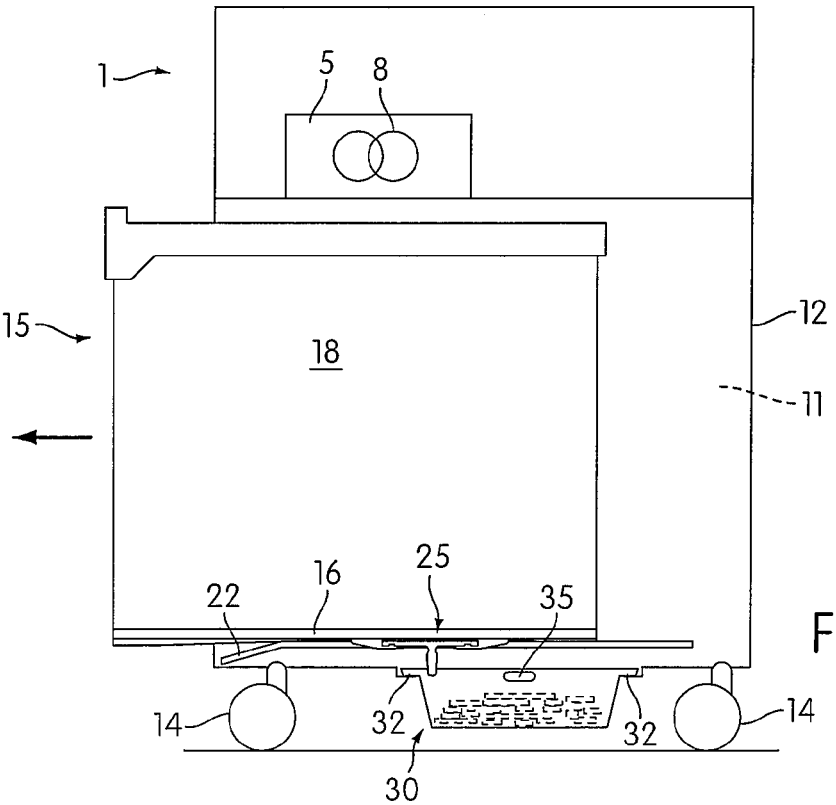
FIG. 6 is a view similar to FIG. 5, showing the primary waste container partially withdrawn.

As users remove or insert the primary waste container 15 of this embodiment from the frame 12 in a generally horizontal direction, as emphasized in FIG. 6, the sweep 25 of this embodiment will run along the frame floor 13, pulling and/or pushing any waste on the floor into the secondary waste container 30.

Figure 7:
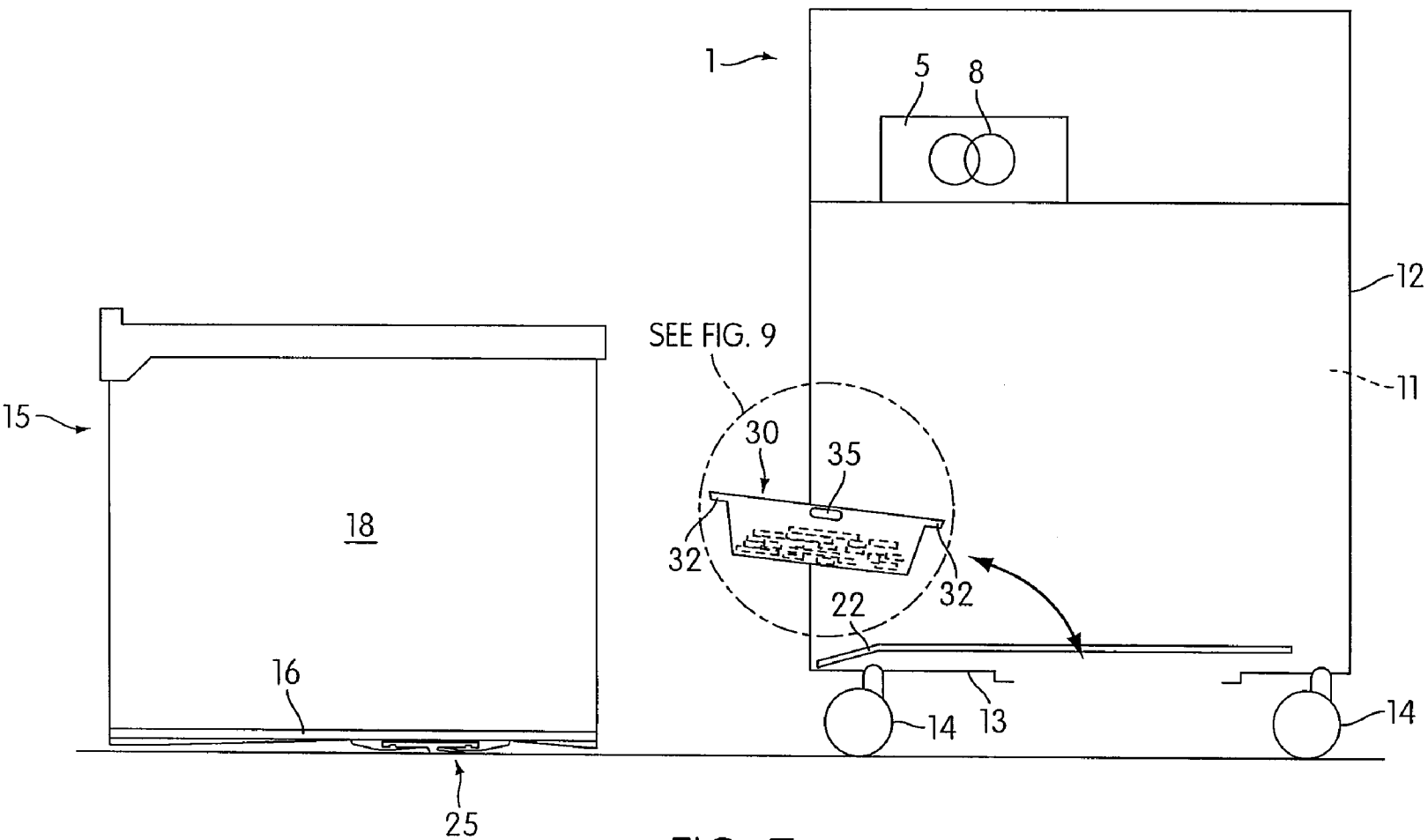
FIG. 7 is a view similar to FIG. 5, showing the removable nature of this embodiment's secondary waste container, and the primary waste container, with mounted sweep bent to a nearly flat position almost flush with the bottom of the primary waste container, facilitating the placement of the primary waste container on the ground.

FIG. 7 highlights the removable nature of the illustrated embodiment's secondary waste container 30. Also visible in this view is that the sweep 25 of this embodiment can bend to an angle almost flush with the primary waste container floor 16, facilitating placement of the primary waste container 15 on the ground.

Figure 8:
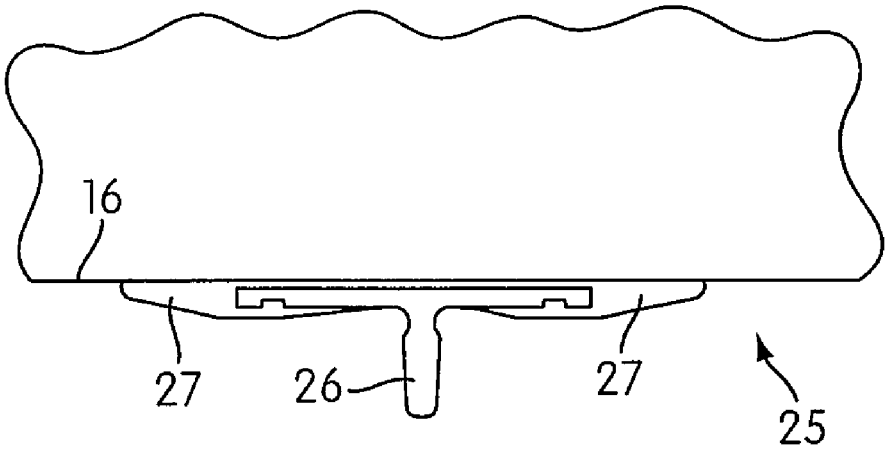
FIG. 8 is a view of an embodiment of the sweep in the present invention.
Figure 10:
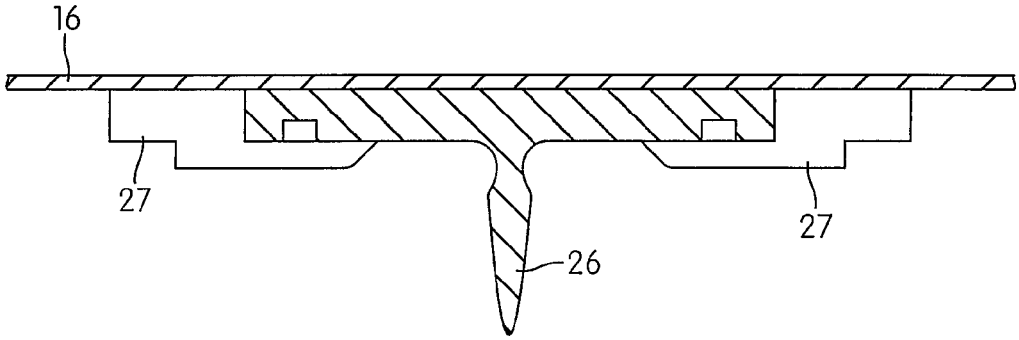
FIG. 10 is a view similar to FIG. 8, showing another embodiment of the sweep of the present invention.
Figure 11:
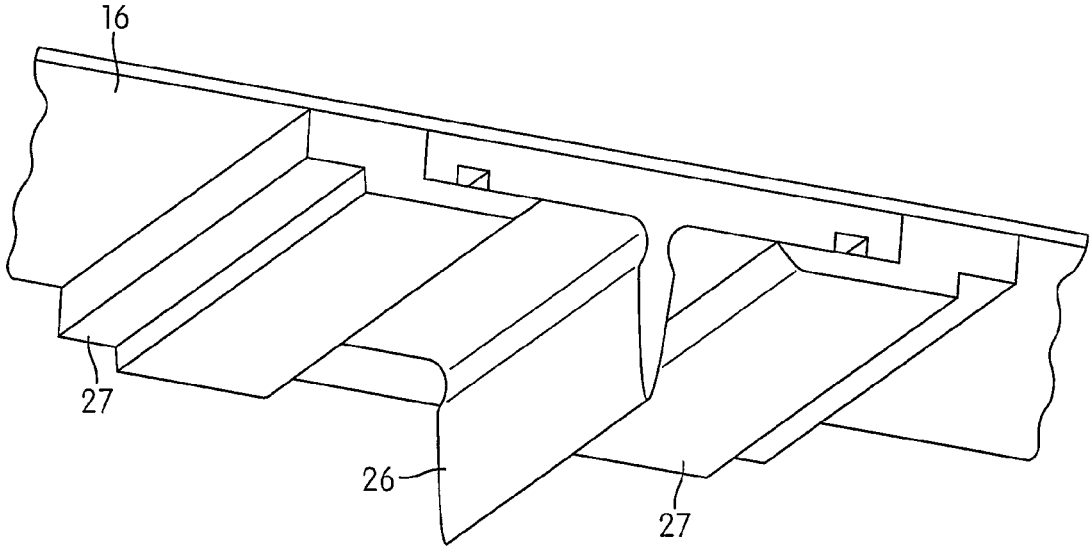
FIG. 11 is a bottom perspective view of the sweep in the present invention.

FIG. 8 shows a side profile close-up view of an embodiment of the sweep 25 as connected to the exterior of the primary waste container floor 16. The sweep 25 may mount to the exterior of the primary waste container floor 16 in any suitable manner, including but not limited to glue, molded plastic, fasteners, integral molding, and ultrasonic welding, and in the illustrated embodiment contains a sweeping arm 26, that is received by a mounting bracket 27, where the mounting bracket is sloped (i.e., at an angle relative to the horizontal direction) at both extremities in the path of the removal or insertion of the primary waste container (not shown), reducing the likelihood of shredded waste being caught by the mounting bracket 27 instead of being pushed and/or dragged by the sweep arm 26. As seen in an embodiment illustrated in FIG. 10 a stepped mounting bracket is also possible. A similar embodiment is illustrated in a perspective view in FIG. 11.

Figure 9:
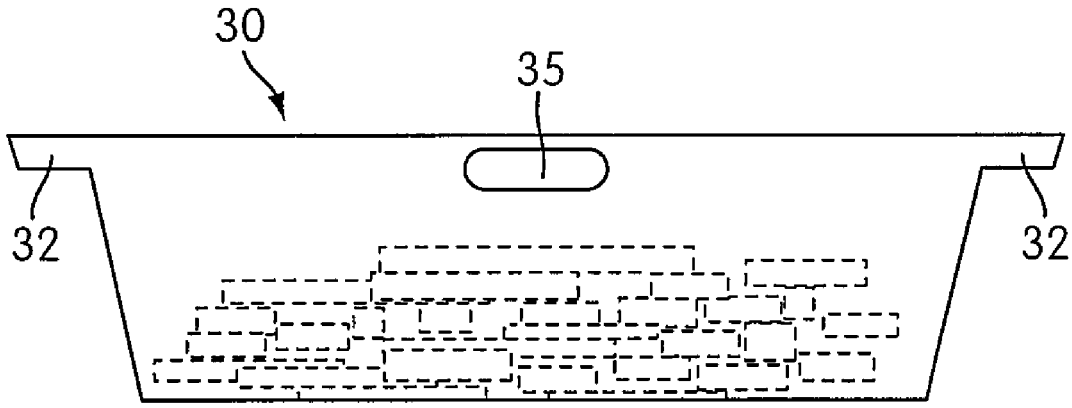
FIG. 9 shows the secondary waste container, in this instance incorporating a handle.

Finally, FIG. 9 shows a close-up side profile cutaway view of the secondary waste container 30. In the illustrated embodiment the secondary waste container 30 contains the optional handle 35 for manual grasping and removal, and flanged edges 32 for use in being received and supported by the edge of an opening in the external frame floor (not shown).

The use of the secondary waste container advantageously makes clean up of the shredded paper or other particles that may accidentally fall between the wall(s) of the external frame and the primary waste container, which may occur either during shredder operation or when the primary waste container is being removed for emptying. During removal of the primary waste container, shredded particles may fall from the top of the primary waste container, or particles stuck in the shredder mechanism may be agitated and dislodged. Irrespective of how the shredded particles fall downwardly between the primary waste container and the frame walls, the secondary waste container and optional sweep provide an effective device for facilitating collection of those particles.

While certain embodiments of the invention have been shown and described it is evident that variations and modifications are possible that are within the spirit and scope of the following claims. The disclosed embodiments have been provided solely to illustrate the principles of the invention and should not be considered limiting in any way.

What is claimed is:

1. A shredder comprising:

a frame;

a paper shredder mechanism received by the frame and including a motor and cutter elements, the motor rotating the cutter elements in an interleaving relationship for shredding paper sheets fed therein;

the frame including walls defining a waste container space beneath said paper shredder mechanism;

a removable primary waste container positioned in the waste container space with an opening facing upwardly to receive shredded paper discharged from the paper shredder mechanism; and a removable secondary waste container positioned below the removable primary waste container with an opening configured for collecting shredded particles that have fallen between the walls of the frame and the primary waste container.

2. A shredder according to claim 1, wherein the frame includes a floor defining a bottom of the waste container space, said floor defining a secondary waste container space wherein said removable secondary waste container is positioned.

3. A shredder according to claim 2, wherein an upper edge of the opening of the secondary waste container is flush with or below the floor so as to facilitate sweeping of the shredded paper along the floor into the opening thereof.

4. A shredder according to claim 3, wherein said secondary waste container has a handle for manual grasping for facilitating removal of the secondary waste container.

5. A shredder according to claim 3, wherein said walls defining said waste container space provide an opening for enabling said primary waste container to be removed in a generally horizontal removal direction from said waste container space.

6. A shredder according to claim 5, wherein said primary waste container comprises a sweep, said sweep being configured to sweep against said floor as said primary waste container is being removed from the waste container space in the generally horizontal removal direction so as to sweep shredded particles into said secondary waste container.

7. A shredder according to claim 6, wherein said sweep comprises a wiper made of rubber or plastic.

8. A shredder according to claim 6, wherein said sweep comprises a textile material.

9. A shredder according to claim 6, wherein said sweep comprises bristles.

10. A shredder according to claim 6, wherein said sweep is received by a mounting bracket on the primary waste container.

11. A shredder according to claim 10, wherein the sides of said mounting bracket are sloped in the generally horizontal directions of the movement of the primary waste container.

12. A shredder according to claim 6, wherein said sweep collects said shredded particles by electrostatic attraction.

* * * * *